US008628399B2

(12) United States Patent
Aoki et al.

(10) Patent No.: US 8,628,399 B2
(45) Date of Patent: Jan. 14, 2014

(54) WAGERING SYSTEM WITH THREE DIMENSIONAL DISPLAY FEATURE

(75) Inventors: Dion K. Aoki, Henderson, NV (US); Alfred Thomas, Las Vegas, NV (US); Brad Schultz, Las Vegas, NV (US); Brett Russell, Henderson, NV (US); Russell Savio, Henderson, NV (US); Peter Aponte, Henderson, NV (US)

(73) Assignee: WMS Gaming Inc., Waukegan, IL (US)

( * ) Notice: Subject to any disclaimer, the term of this patent is extended or adjusted under 35 U.S.C. 154(b) by 672 days.

(21) Appl. No.: 12/526,098

(22) PCT Filed: Feb. 6, 2008

(86) PCT No.: PCT/US2008/001571

§ 371 (c)(1),
(2), (4) Date: Oct. 29, 2010

(87) PCT Pub. No.: WO2008/097577

PCT Pub. Date: Aug. 14, 2008

(65) Prior Publication Data

US 2011/0053675 A1 Mar. 3, 2011

Related U.S. Application Data

(60) Provisional application No. 60/899,742, filed on Feb. 6, 2007.

(51) Int. Cl.
*A63F 9/24* (2006.01)

(52) U.S. Cl.
USPC ..... 463/20; 463/15; 463/16; 463/30; 463/32; 463/40

(58) Field of Classification Search
USPC ..... 463/15, 16, 20, 40, 30, 32
See application file for complete search history.

(56) References Cited

U.S. PATENT DOCUMENTS

| | | | | |
|---|---|---|---|---|
| 6,887,157 | B2 * | 5/2005 | LeMay et al. | 463/32 |
| 6,960,134 | B2 * | 11/2005 | Hartl et al. | 463/20 |
| 6,981,635 | B1 | 1/2006 | Hughs-Baird et al. | |
| 2001/0016513 | A1 * | 8/2001 | Muir et al. | 463/16 |
| 2004/0009804 | A1 * | 1/2004 | Dumont | 463/16 |
| 2004/0102244 | A1 * | 5/2004 | Kryuchkov et al. | 463/32 |
| 2004/0102245 | A1 * | 5/2004 | Escalera et al. | 463/32 |
| 2005/0245307 | A1 * | 11/2005 | Gatto et al. | 463/16 |
| 2006/0135242 | A1 * | 6/2006 | Tarantino | 463/16 |
| 2006/0199638 | A1 * | 9/2006 | Walker et al. | 463/30 |
| 2007/0225062 | A1 * | 9/2007 | Yamaguchi | 463/20 |
| 2009/0104969 | A1 * | 4/2009 | Paulsen et al. | 463/20 |
| 2009/0125163 | A1 * | 5/2009 | Duggan et al. | 701/2 |
| 2011/0300920 | A1 * | 12/2011 | Slomiany et al. | 463/20 |

OTHER PUBLICATIONS

Written Opinion corresponding to co-pending International Patent Application Serial No. PCT/US2008/001571, United States Patent Office, dated Jun. 25, 2008.

(Continued)

*Primary Examiner* — Arthur O. Hall
*Assistant Examiner* — Shahid Kamal
(74) *Attorney, Agent, or Firm* — Nixon Peabody LLP

(57) ABSTRACT

A gaming system and method allowing use of three dimensional objects in a wagering game. The three dimensional object includes multiple sides which are viewable by a player. Each of the multiple sides includes a symbol. An active payline contains one of the symbols. The symbols contained by the active payline are used to represent a randomly-determined result from the wagering game.

15 Claims, 14 Drawing Sheets

(56) References Cited

OTHER PUBLICATIONS

International Search Report corresponding to co-pending International Patent Application Serial No. PCT/US2008/001571, United States Patent Office, dated Jun. 25, 2008.

International Preliminary Report on Patentability corresponding to co-pending International Patent Application Serial No. PCT/US2008/001571, United States Patent Office, dated Mar. 23, 2009.

* cited by examiner

WAGERING SYSTEM WITH THREE DIMENSIONAL DISPLAY FEATURE

CROSS REFERENCE TO RELATED APPLICATIONS

This application is a U.S. national stage of International Application No. PCT/US2008/001571, filed Feb. 6, 2008, which is related to and claims the benefit of U.S. Provisional Application No. 60/899,742, filed Feb. 6, 2007, each of which is incorporated herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to wagering games, and more particularly, to a wagering game system with three dimensional display features.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

Gaming machines have also utilized a variety of enhanced graphics to provide excitement to and attract players. Current video displays are inherently limited to displaying two dimensional graphics. Three dimensional graphics may sometimes be provided, but the properties of three dimensional virtual space have not been fully utilized.

Thus, a need exists for a game system having enhanced three dimensional features to allow a player additional paylines based on symbols in different dimensions. There is a further need for a game system allowing the rendering of three dimensional objects for player manipulation as a part of a wager.

SUMMARY OF THE INVENTION

According to one example disclosed a gaming system for a wagering game includes a first three dimensional object having at least two visible dimensional sides with at least one symbol on each visible dimensional side. The gaming system includes an active payline containing at least one symbol of the first three dimensional object. A controller is provided to represent a randomly selected outcome of the wagering game via the at least one symbol contained in the active payline Another example disclosed is a method of conducting a wagering game having a randomly-selected outcome. A first three dimensional object is displayed having at least two visible dimensional sides with at least one symbol on each visible dimensional side. An active payline is provided containing at least one symbol of the first three dimensional object. The randomly selected outcome game is represented via the at least one symbol contained in the active payline.

Another example disclosed is a gaming system for playing a wagering game. The system includes a plurality of three dimensional loop shaped reels, each of the plurality of reels having multiple viewable symbols. An active payline is provided containing one viewable symbol on each of the plurality of three-dimensional loop shaped reels.

Another example is a gaming system for a wagering game having a three dimensional object including at least three visible sides. Each of the three sides includes at least one symbol in a different dimension from the other sides. An active payline contains at least one symbol on one of the three visible sides. A controller represents a randomly-determined outcome by the one symbol contained in the active payline.

Yet another example is a gaming system for playing a wagering game including a three dimensional gameboard graphic. A three dimensional playing piece graphic is positioned relative to the gameboard graphic. A controller represents a randomly-determined outcome by the position of the three dimensional playing piece on the gameboard graphic.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
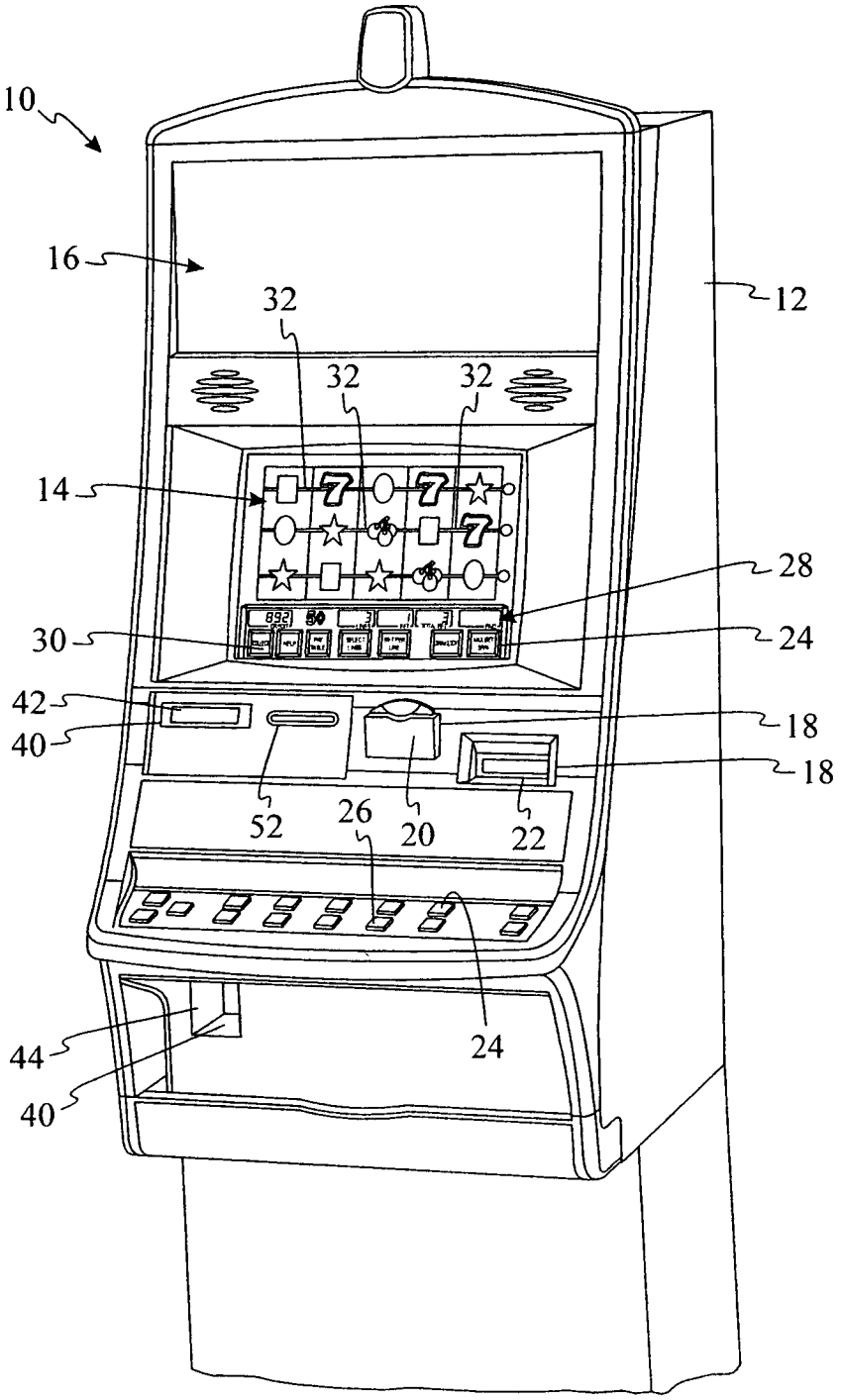
FIG. 1*a* is a perspective view of a free standing gaming machine.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
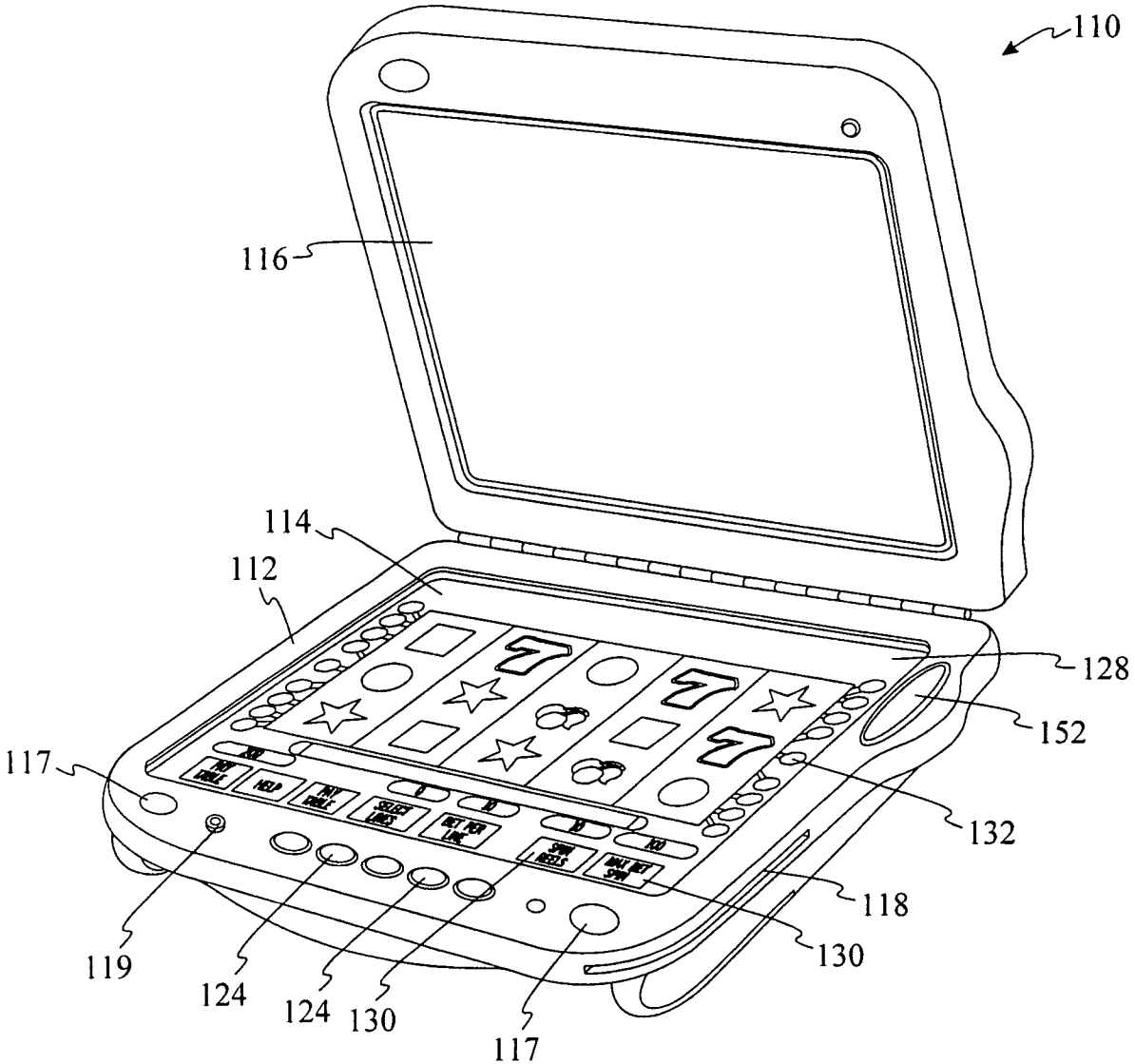
FIG. 1*b* is a perspective view of a handheld gaming machine.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, blackjack, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons 126 on a button panel for operating the handheld gaming machine 110. In addition, or alternatively, the player input device 124 may comprise a touch screen mounted to a primary display 114 and/or secondary display 116. In one aspect, the touch screen is matched to a display screen having one or more selectable touch keys 130 selectable by a user's touching of the associated area of the screen using a finger or a tool, such as a stylus pointer. A player enables a desired function either by touching the touch screen at an appropriate touch key 130 or by pressing an appropriate push button 126 on the button panel. The touch keys 130 may be used to implement the same functions as push buttons 126. Alternatively, the push buttons 126 may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 10. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1, comprises a biometric sensing device.

Figure 2:
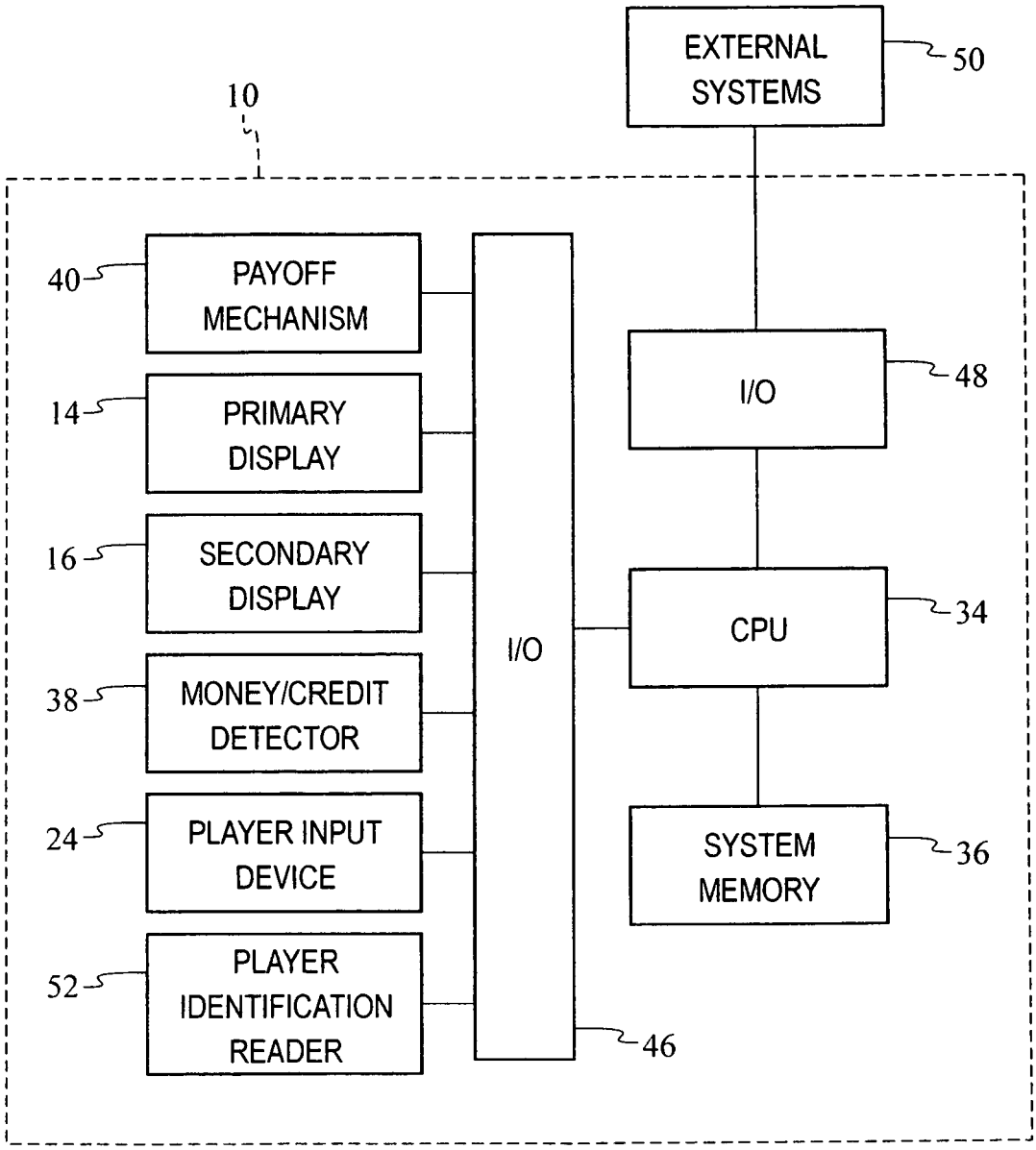
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10, 110 may communicate with external systems 50 (in a wired or wireless manner) such that each machine operates as a "thin client," having relatively less functionality, a "thick client," having relatively more functionality, or through any range of functionality therebetween. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

The principles described herein enhance wagering games using three dimensional (3D) features. The "mechanical-like" feel of 3D instills confidence in players who play traditional mechanical wagering games in that, among other things, they have an opportunity to see the wagering game results displayed by symbols which appear fixed.

According to other aspects of the present invention, the player can rotate the views of a scene depicted on the video display such as with a virtual camera or following moving objects with a virtual camera and can also manipulate 3D objects displayed on the video screen. By rotating views, players can view the wagering game from all viewing angles and can even view wagering game elements that cannot be seen in existing mechanical gaming machines or gaming machines that display two dimensional images. Another advantage to three dimensional images is that they add a dimension of realism that can create the impression that a wagering game is less "random" than it actually is. The realistic environment helps cement the impression that other factors (such as skill, placement of player-selectable objects, timing of selections, and the like) may affect the ultimate game outcome, even though it is in fact unaffected by these perceived factors.

Figure 3:
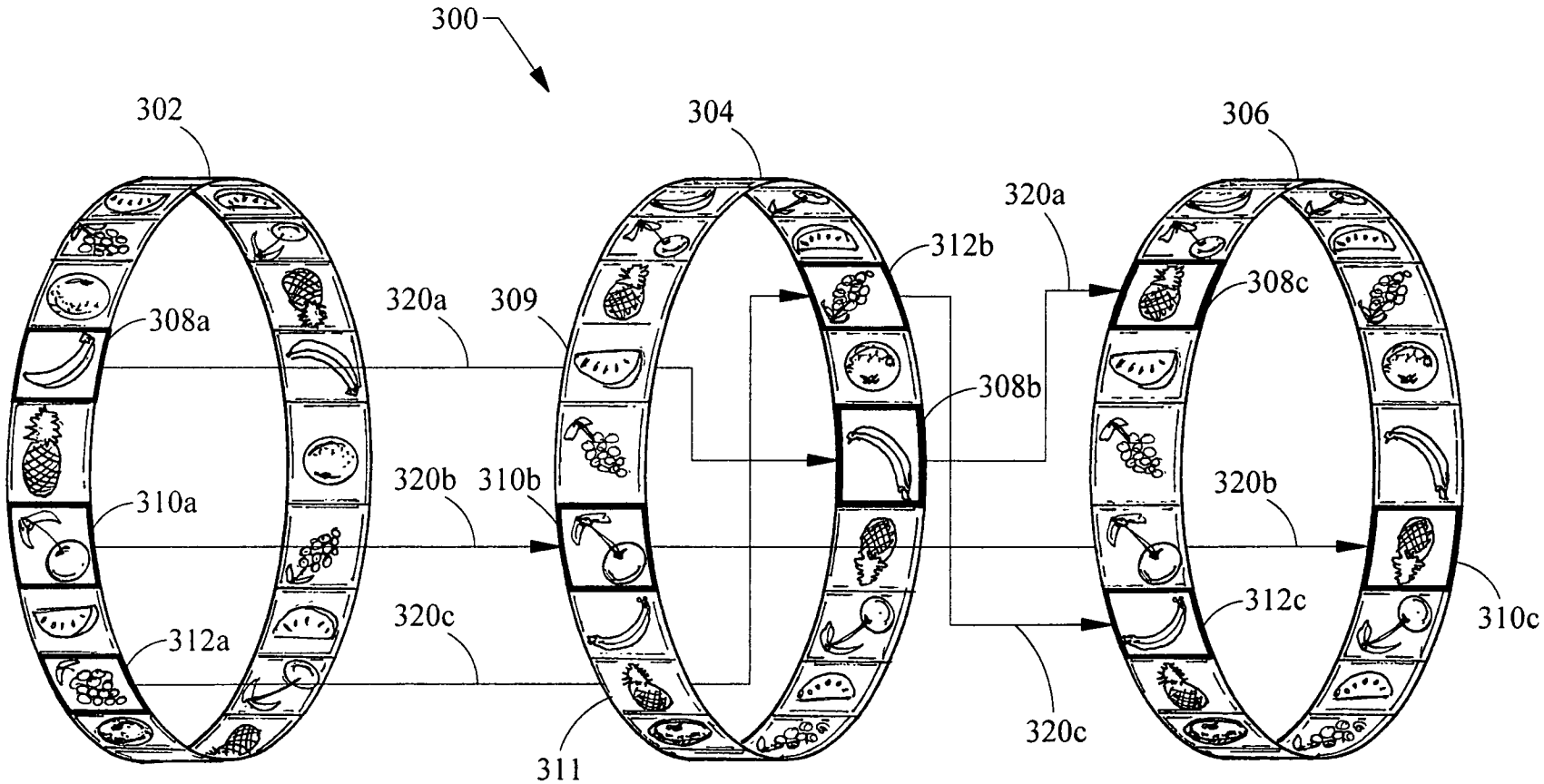
FIG. 3 is an illustration of a graphic display for a three dimensional slot wagering game.

FIG. 3 is an illustration of an exemplary display graphic 300 in conjunction with a slot-type wagering game played on the gaming machine 10 or 110. The display graphic 300 may be displayed on the primary display 14 or the secondary display 16 of the gaming machine 10. The display graphic 300 portrays a three dimensional slot game having a number of three dimensional objects related to the wagering game, such as 3D reels 302, 304, and 306. Although three reels are shown in this example, it is to be understood that additional reels, such as five, may be used. The reels 302-306 each have a number of symbols, such as symbols 308, 310, 312, distributed on the reel surface. Because the reels 302-306 are rendered in three dimensions, all or substantially all of the symbols 308 on each of the reels 302-306 may be viewed by the player. Thus, reel symbols that are traditionally obscured by mechanical displays or 2D video displays are visible to the player. Because the perspective view of the reels is slightly offset, the symbols behind the front portion of the reel are visible.

The player's ability to see additional reel symbols greatly increases the number of possible paylines that can be made available to the player because the payline combinations can include combinations that include previously hidden or obscured symbols. It also increases the player's sense of anticipation and excitement, because instead of seeing just three or five symbols per reel, the player can see all or nearly all of the symbols. The combination of the symbols 308 on the different reels 302, 304 and 306 may be used to represent a predetermined outcome from the wagering game. The symbols 308 may be attractive icons which enhance the gaming experience. In this example, the symbols 308 are fruit-type symbols, though any other thematic symbols can be used. Preferably, the symbols displayed on the rear portion of the reels 302-306 are reversed as if they are being transparently viewed through the back of the reel itself. Alternately, the symbols displayed on the rear portion of the reels 302-306 can be righted so that they display to the player as if the player viewed them from the front. In this alternate arrangement, words and letters on symbols, for example, on the rear portions of the reels will be displayed properly so that they can be read by the player. As that symbol moves from the rear to the front portion of the reel 302, 304, 306, the controller 34 reverses the image displayed on the symbol as it transitions from the rear to the front visible area of the reel display 300.

In this example, a player makes a first wager input via the value input device 18 that is associated with a first group of active 3D paylines 320*a,b,c* that are selected by a player. Only three 3D paylines are shown here for clarity purposes; fewer or additional 3D paylines can be shown and are selectable by the player. Compared to traditional reel-based wagering games, many more payline combinations are possible with aspects of the present invention because every or nearly every symbol disposed about the reels 302, 304, 306 is visible to the player and therefore can be involved in the game outcome. The 3D paylines 320*a,b,c* include groups of three symbols from each of the reels 302-306. In response to receiving the wager input, a randomly-selected outcome is selected from a plurality of outcomes including at least one winning outcome. The plurality of outcomes is represented via the symbols arranged in the reels 302, 304 and 306. The 3D paylines 320*a,b,c* each contain a plurality of symbols that indicate a randomly selected outcome that is arranged from left-to-right on the reels 302, 304 and 306.

In the example shown, 3D payline 320*a* begins at front symbol 308*a*, appears to run "behind" symbol 309, runs through rear symbol 308*b*, and ends at front symbol 308*c*. The 3D payline therefore appears to "bend" as it traverses from the front of the first reel 302 to the back of the second reel 304 and finally back to the front of the third reel 306. Similarly, 3D payline 320*b* begins at front symbol 310*a* on the first reel 302, runs through front symbol 310*b* on the second reel 304, and ends at rear symbol 310*c* on the third reel 306. 3D payline 320*c* begins at front symbol 312*a* on the first reel 302, appears to run behind symbol 311, runs through rear symbol 312*b* on the second reel 304, and ends at front symbol 312*c* on the third reel 306. The 3D paylines can crisscross one another in a virtual 3D space, passing through symbols that would normally be obscured on the back of a traditional reel, allowing a great number of interesting payline possibilities.

The option of wagering on multiple 3D paylines, such as 3D paylines 320*a,b,c*, may be selected by a player via a button on the push-buttons 26 or via the touch-screen 28. Alternatively, the 3D paylines, such as 3D paylines 302, 304, 306, may be activated automatically, such as when a player makes a wager input at the gaming machine 10, 110. It should be noted that conventional 2D paylines (paylines along a single plane) can also be shown and be selected by the player in addition to the 3D paylines that appear to run across multiple planes.

Still referring to FIG. 3, the reels 302-306, which are also referred to as symbol-bearing reels or spinning reels, are in a stopped position. The reels 302-306 may be activated by the player after making a wager and a 3D image representation of the reels 302-306 spinning may be displayed. As the reels are spinning, symbols located in the rear portions of the reels, such as symbols 308*b*, 312*b*, and 310*c*, also appear to be spinning with the reels. During the wagering game, to achieve a winning symbol combination according to an implementation, two or more symbols on the reels 302-306, starting from the leftmost reel 302 must be contained in an active payline. As shown in FIG. 3, three 3D paylines 320*a-c* have been selected by the player and are, therefore, active. A payline indicator is used to indicate whether a particular payline is active. For example, the payline indicator may include a highlighting (e.g., a highlighted or colored border) on a particular symbol to indicate that each one of the 3D paylines 320*a-c* is active, and an assigned number to indicate a respective payline to the player (e.g., the payline 320*a* is indicated to the player as an active payline).

An aspect of the present invention utilizes 3D paylines that appear to bend into the plane of the reels and, as a result, can involve rear symbols "behind" the front-facing symbols. The rear symbols, such as symbols 308*b*, 312*b*, and 310*c*, are in a plane generally parallel to the plane on which the front symbols, such as symbols 308*a*, 310*a*, 312*a*, 310*b*, 308*c*, 312*c*, are located.

The three dimensional nature of the reels 302-306 allows a player to activate any payline such as any of paylines 320*a-c*, which may contain any of the visible symbols on any of the reels 302-306 including symbols on the opposite side of the reels, such as symbols 308*b*, 312*b*, and 310*c*. These paylines 320*a-c* may contain a combination of visible symbols anywhere on the reels 302-306, including the front, top, bottom, and back. Because the 3D-rendered display shows all or substantially all of the symbols of the reels 302-306 to a player, numerous paylines may be activated. The paylines may contain symbols in different dimensions because visible symbols on the reels 302-306 are in three dimensions. In this manner, a player may wager more credits to cover many more paylines than a two dimensional display, encompassing symbol combinations that are not possible with traditional reel displays because the majority of the symbols are hidden from view and only permit paylines that exist in a single plane.

Figure 4:
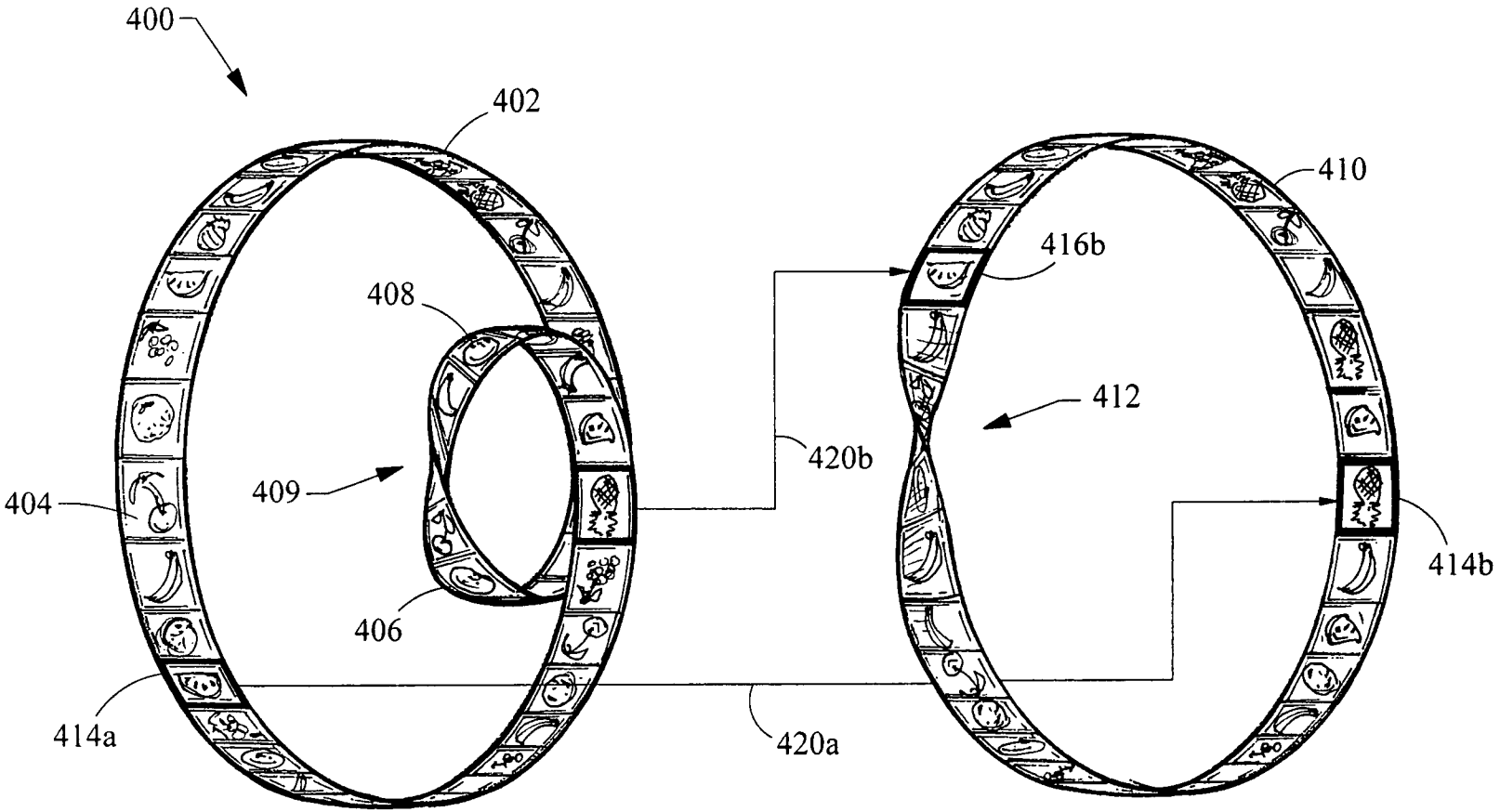
FIG. 4 is an illustration of a graphic display for a second example three dimensional slot wagering game.

FIG. 4 shows video slot graphic 400, which may be displayed on the primary display 14 or the secondary display 16 of the gaming machines 10 or 110. In an aspect, the graphic 400 includes a modified reel 402, which may be used for any of the reels 302, 304, or 306 in the wagering game shown in FIG. 3. In another aspect, the graphic 400 includes a modified reel 410, which may be used for any of the reels 302, 304, or 306 in the wagering game shown in FIG. 3. The modified reel 402 has symbols 404, 406, 408 which are distributed on a ribbon or strip, which resembles a Möbius strip with a half twist 409 along its length forming a single continuous surface, and thus the symbols 404, 406, 408 are viewable on both sides of the reel 402. As is known, a Möbius strip has a surface with only one side and only one boundary component. Accordingly, there are symbols 404 on one side of the ribbon 402 as well as different symbols 406 on the opposite side of the ribbon 402. Likewise, the modified reel 410 also resembles a Möbius strip that has been joined with a half twist 412. The doubling of symbols on the strips 402, 410 allows for many more paylines in conjunction with other conventional reels with symbols only on one side of the reel. The reels 402, 410 shown in FIG. 4 are termed "Möbius reels."

As the Möbius reels 408, 410 appear to "spin," the symbols 404, 406, 408 follow a single, continuous curve (the only boundary present in a Möbius strip). In this manner, the symbols 404, 406, 408 are disposed on only one side, but double the number of symbols can be displayed compared to a non-Möbius reel because of the properties of a Möbius strip. By exploiting these properties, this implementation adds a new twist to the wagering game experience with numerous more possible winning combinations and more options for the player. The Möbius reel can also create the impression in the player that because double the number of symbols are present compared to traditional reels, the probabilities of winning are higher, even though in reality the probabilities of winning may be no greater than compared to traditional reel games.

The half twist 409, 412 necessary to form the Möbius reel 402, 410, respectively, may be positioned such that it is displayed at the back of the virtual 3D space, such as shown in Möbius reel 402 or in the front of the virtual 3D space, such as shown in Möbius reel 410. The symbols on the reels 402, 410 appear to twist and invert as they pass the twist point 409, 412 and will seem to disappear from view until they come back into view after two revolutions. Preferably, the modified reels 402, 410 are non-transparent in order to permit the maximum number of symbols on the Möbius strip. For example, if there are normally 27 symbols on one surface of a traditional reel strip, there can be up to 54 symbols on the only surface of a Möbius reel strip having the same dimensions as the traditional reel strip in accordance with aspects of the present invention. But it would take twice as long for a symbol, e.g., symbol 416*b*, to reappear in the same location where it was last seen because it has to traverse the entire Möbius surface along with the other 53 symbols. By exploiting the intriguing properties of a Möbius strip, aspects of the present invention greatly enhance the sense of anticipation and excitement in the player, and makes possible more many symbol possibilities and winning combinations compared to traditional slot games.

Also shown in FIG. 4 are two exemplary 3D paylines 420*a* and 420*b* that appear to extend into the viewing plane so that they involve symbols on any part of the surface of the Möbius reels 402, 410—e.g., the front, top, bottom, or rear portions of the surface or anything in between. For example, 3D payline 420*a* begins on symbol 414*a*, extends behind the reel 410, and ends at symbol 414*b*, which is on a plane behind the plane in which symbol 414*a* disposed. The payline 420*a* appears to bend in the virtual 3D space from the front of the graphic 400 to the rear.

As with the previous example, a player makes a first wager input via the value input device 18 that is associated with a first group of paylines 420*a*, 420*b* that are activated by a player. The use of the modified reels 402, 410 increases the number of paylines which may be activated by a player if the modified reel 402 is substituted for any of the reels 302-306. Of course it is to be understood that replacing all of the reels 302-306 in FIG. 3 with modified reels such as the modified reel 402 or 410 will increase greatly the number of available paylines for activation by the player and the number of symbols that can be displayed on the reels.

Figure 5A:
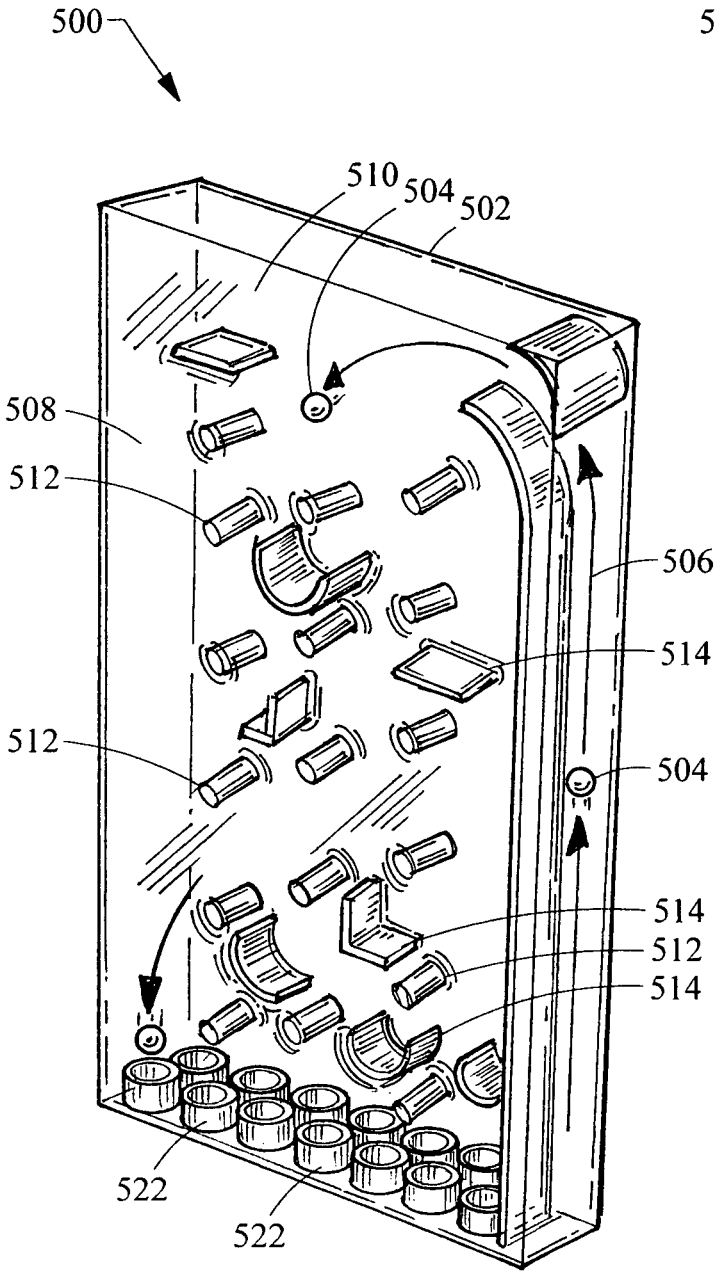
FIG. 5A-5B are illustrations of a graphic display for an example three dimensional Pachinko style wagering game.
Figure 5B:
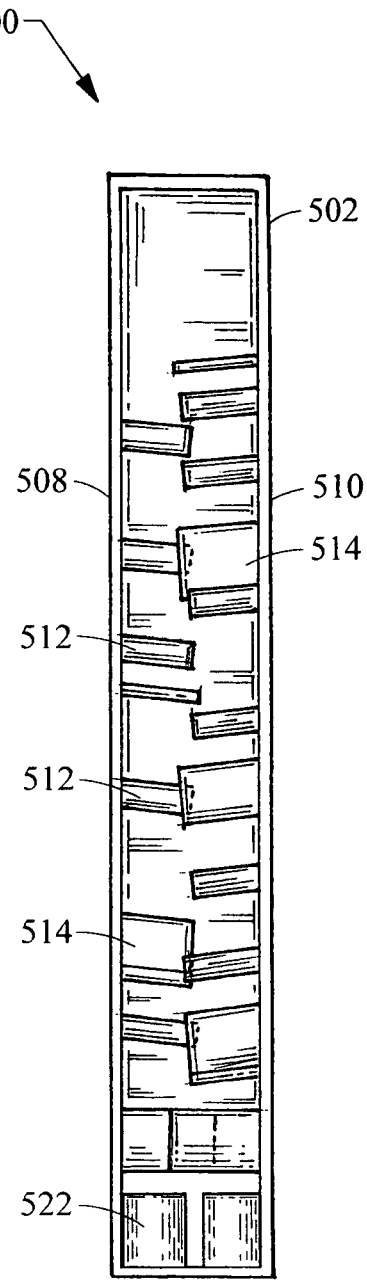

FIGS. 5A and 5B are perspective and side illustrations, respectively, of a three dimensional display graphic 500, which may be displayed on the primary display 14 or the secondary display 16 and which may be used to show a predetermined outcome of a wagering game played on the gaming machine 10 or 110. The 3D display graphic 500 in this case resembles a Pachinko-type wagering game that includes a gameboard 502. As with the previous examples, a player makes a first wager input via the value input device 18 that is associated with a ball or balls 504 which are shown by the graphic 500. In this example, the ball 504, once launched through a chute 506, may fall into any one of different cups arranged at the bottom of the gameboard 502. As with other wagering games, a randomly-selected outcome is determined in response to receiving a wager input from a player. The randomly-selected outcome is selected from a plurality of outcomes including at least one winning outcome which may be one of the cups that the ball 504 may land in.

Each ball 504 is 3D-rendered to appear to be spring-inserted into the gameboard 502 via the chute 506, which deposits the ball at the top of the gameboard 502. In order to create the appearance of a random path, various obstacles are located on two transparent side walls 508 and 510 between the top and bottom of the gameboard 502. The obstacles include various pegs 512 and guides 514 which affect the path in three dimensions of the ball 504 from the top to the bottom of the gameboard 502. Because the transparent side walls 508 and 510 form the gameboard 502 and are rendered in three dimensions, the ball 504 may travel in the two dimensions from the top to the bottom of the gameboard 502 as well as in the third dimension of the space between the transparent side walls 508 and 510. Thus, the pegs 512 and the guides 514 may be mounted on either transparent side wall 508 or 510 and extend partially or wholly between the transparent side walls 508 or 510. Likewise, different target cups 522 may be located at different areas of the bottom surface. In this example, there are two rows of cups 522 which are roughly two ball lengths in width but it is to be understood that widths of greater than two ball lengths may be used with appropriately more complicated mazes of pegs and guides in the gameboard 502. The wagering game allows a player to purchase a certain number of balls and send the balls through the gameboard 502. Hitting a cup 522 with the ball 504 results in an award while no award results by missing all the cups 504 and falling to the bottom of the gameboard 502.

Figure 6B:
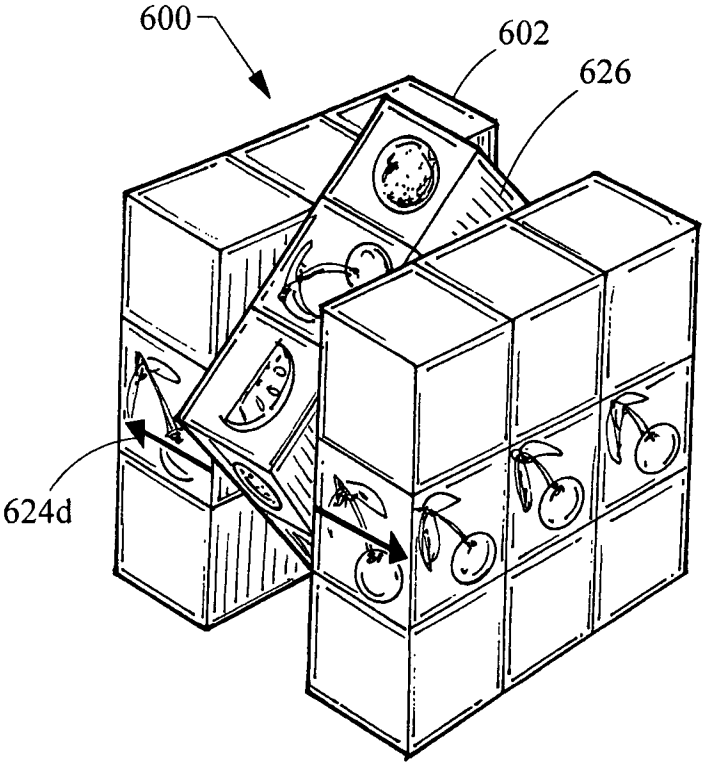
FIG. 6A-6C are illustrations of a graphic display for an example three dimensional cube wagering game.
Figure 6A:
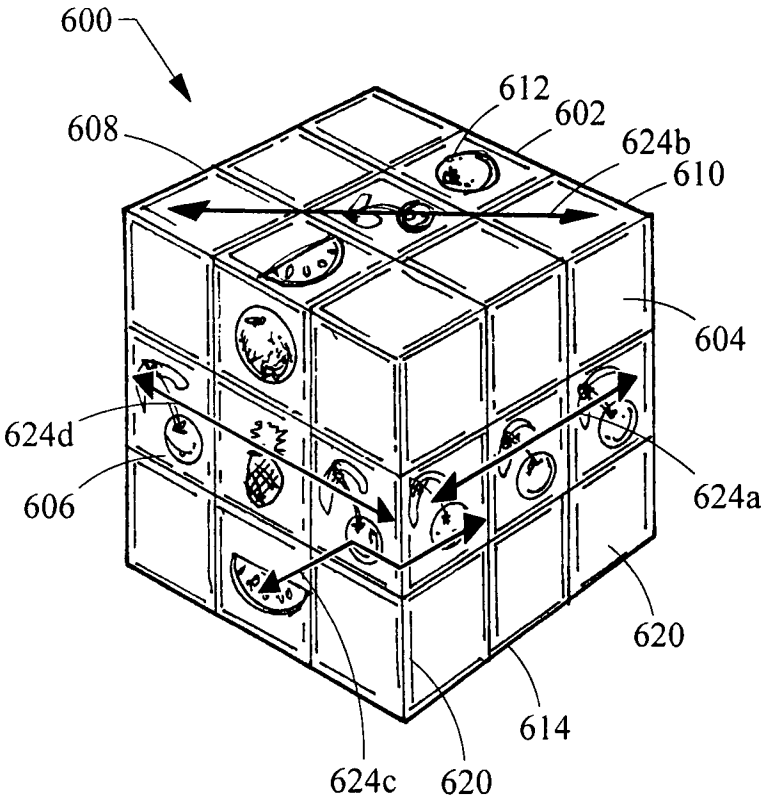
Figure 6C:
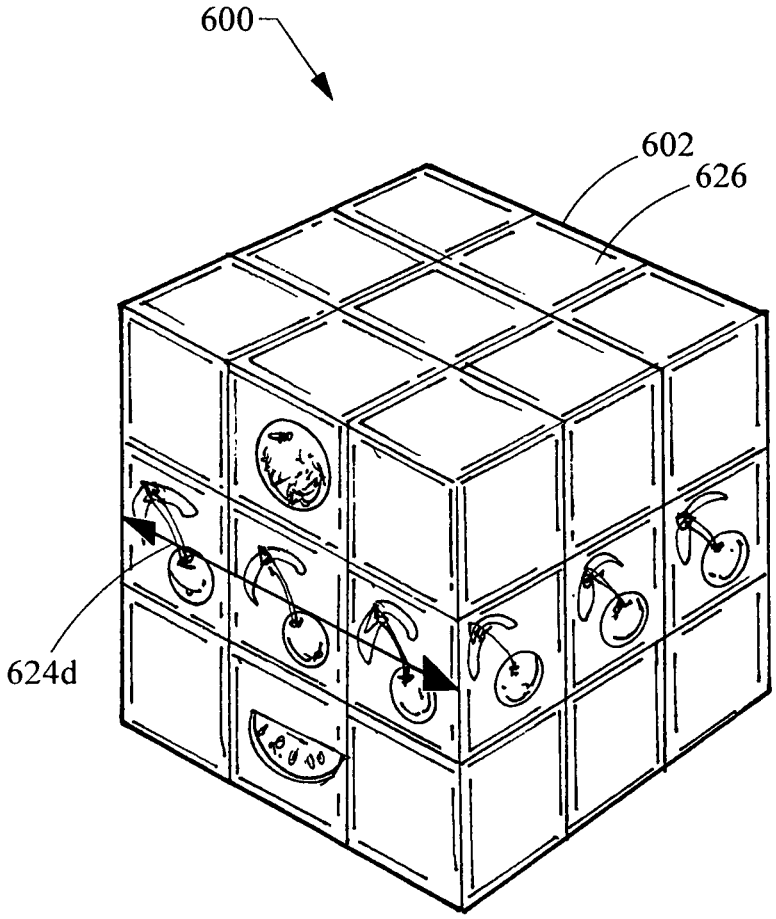

FIGS. 6A-6C illustrate a wagering game display graphic 600 that may be shown on the primary display 14 or the secondary display 16 of the gaming machine 10 or 110. A randomly-selected outcome is determined in response to receiving the wager input. The randomly-selected outcome is selected from a plurality of outcomes including at least one winning outcome. The wagering game display graphic 600 includes a 3D object that is a puzzle-type cube 602 similar to a RUBIK'S CUBE® that allows rotation of different faces of the cube components. The primary cube 602 has six distinct faces 604, 606, 608. 610, 612 and 614. Each face, such as the face 604, is composed of a nine different cubes 620 that have various symbols on the sides of the cubes 620 visible to the player. In FIGS. 6A-6C, some symbols are not shown for clarity purposes, though it is contemplated that all or some of exposed surfaces of the cubes 620 include a fixed or changing wagering-game symbol.

The wagering game using the graphic 600 allows a player to activate different paylines that may extend across the faces 604-614 of the cube 602. For example, paylines 624*a*-624*c* are shown on the primary cube 602. A payline may extend across a 2D row of cubes on one of the faces such as the payline 624*a* on the face 604. Alternatively, a payline may be a diagonal through the nine cubes such as the payline 624*b* on the face 612. Finally, the payline may be extended over more than one plane by being bent or wrapped around two or more faces of the primary cube 602 such as the payline 624*c* which wraps around the faces 606 and 614. The symbols on the primary cube 602 may be assigned after an initial wager is received and different winning outcomes may be determined and displayed by the appearance of identical symbols on the faces of the primary cube 602.

For additional wager inputs or as a bonus game, the player via the player controls 24 may manipulate the graphic of the primary cube 602 by rotating and reorienting each of the faces to align new symbols with active paylines to achieve a potentially winning outcome. For example, FIG. 6A shows the cube 602 in an initial orientation where the payline 624*a* is a winning payline (identical CHERRY symbols), but suppose that payline 624*d* is not a winning payline. A player may insert additional wagers or as part of a bonus game manipulate the primary cube 602 to reorient the cubes to create a second winning payline as shown in FIG. 6B where a group of cubes 626 is being rotated to align a winning set of symbols on the payline 624*d*. The graphic 600 simulates movement of the cube as shown in FIG. 6B and the final result may be shown in FIG. 6C which shows the new winning payline 624*d* on the side 606.

The player may be shown a limited number of faces of the cube 602 as in FIG. 6A which only shows three faces of the primary cube 602. The player may select paylines containing symbols on any of the three visible faces or combinations thereof (faces 604, 606 and 608 in FIG. 6A). Additionally, the player may play simultaneously three wagering games on the three visible faces by selecting paylines associated with each face. A modified payline may be offered where a three-symbol payline such as the payline 624*a* may become a four-symbol payline with the fourth symbol continuing around a corner of the face 604 on which the three symbols are located to another face such as the face 606.

Alternatively, a player may have the option to manipulate the views of the cube 602 in three dimensions via rotation of the entire cube 602 and hence view all of the faces of the primary cube 602. Alternatively, after a winning outcome, the faces of the cube 602 may be automatically rotated to display new symbols and present the player with the possibility of other winning combinations on the active paylines. Further, the entire cube 602 may be rotated to present a new face of nine symbols to the player In various embodiments, a payline can wrap around any number of faces (from 1 to 6), whether adjacent or non-adjacent, and in any direction. The number of symbols within a payline can be variable, varying from three to 12 or more than 12. For example, a payline could extend across one face, wrap around to an adjacent face, and terminate on a single symbol on the adjacent face rather than continuing to extend across all symbols of that adjacent face. The number of cubes on each face can be more than three, such as four or five. The symbols may be colors as on a traditional RUBIK'S CUBE®, animated or fixed designs such as fruit-themed symbols, numbers such as in the Sudoku game, or any other suitable symbol that conforms to a desired theme of the wagering game.

Figure 7A:
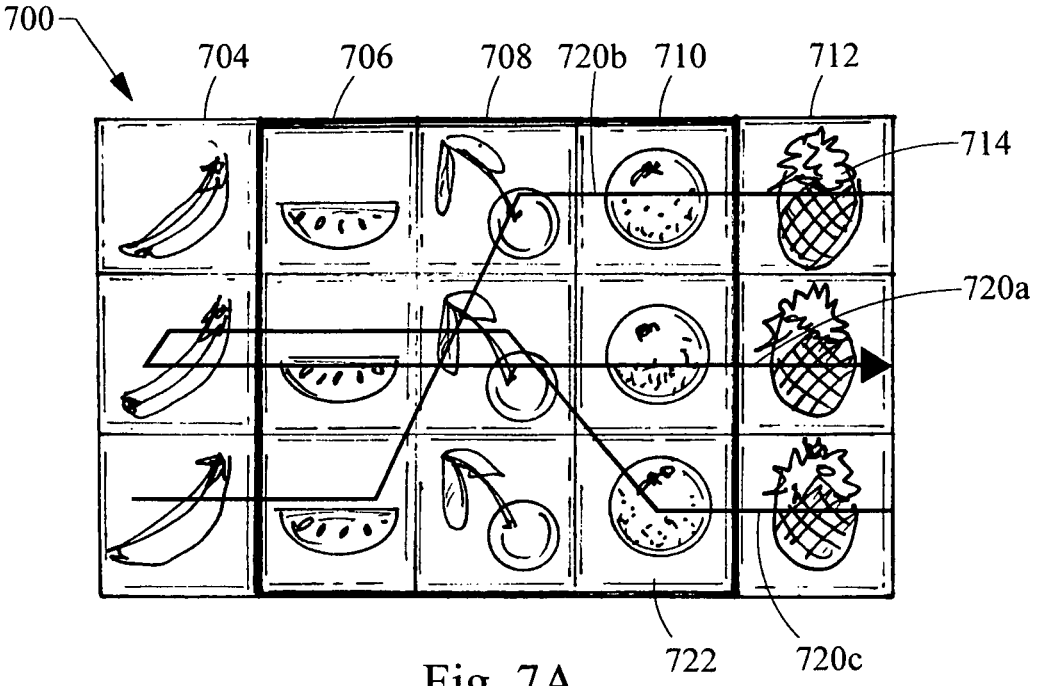
FIG. 7A-7B are illustrations of a graphic display for another example three dimensional reel type wagering game.
Figure 7B:
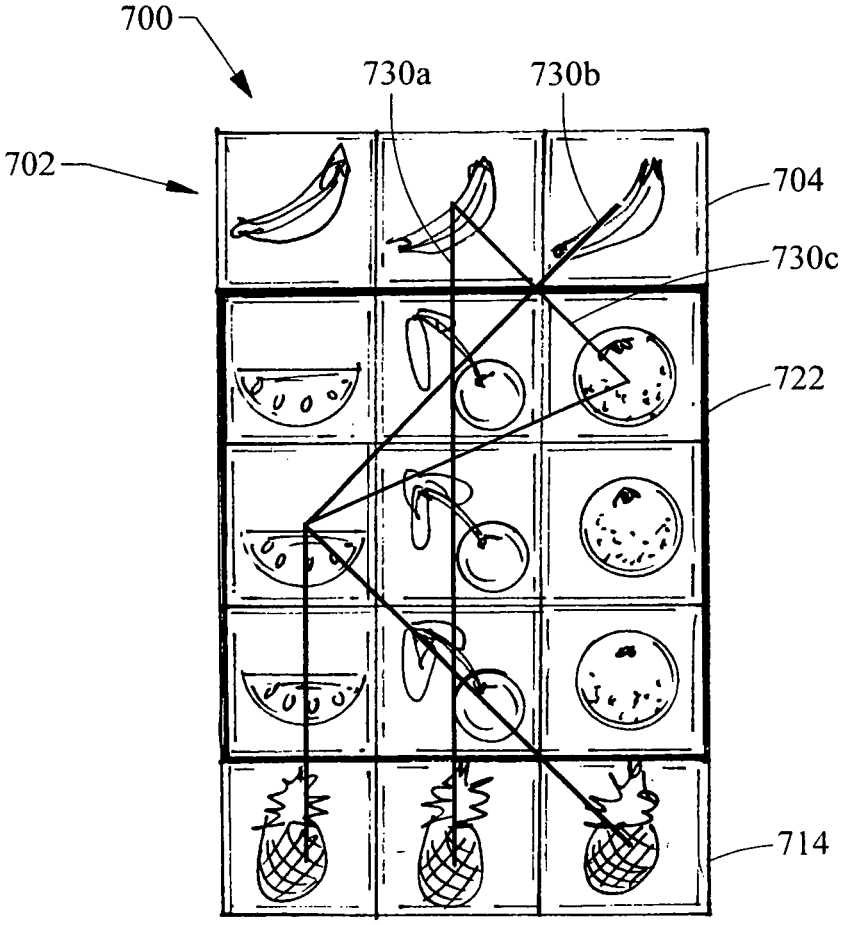

FIGS. 7A-7B illustrate a wagering game graphic 700 that may be shown on the primary display 14 or on the secondary display 16 of the gaming machine 10 or 110. A randomly-selected outcome is determined in response to receiving the wager input. The randomly-selected outcome is selected from a plurality of outcomes including at least one winning outcome. The plurality of outcomes may be shown on the different faces of a reel array 702. The reel array 702 has a plurality of reels 704, 706, 708, 710 and 712, which each present a number of symbols 714. In this example, the reels 704-712 display three symbols in the vertical direction and five symbols in the horizontal direction resulting in fifteen overall symbols being displayed. The randomly selected outcome is displayed via symbols on the different rows and combinations of symbols on the reels 704-712. A player may activate one or more paylines, such as the paylines 720*a*-*c*, incorporating the different symbol combinations of the reel array 702. After a player makes a wager, the reels 704-712 are spun and brought to a stop position. The symbols 714 are shown on the reels 704-712 in the stop position in FIG. 7A. The player is awarded wins along active paylines which have three or more of the same symbols starting from the leftmost reel 704.

After the reels 704-712 are stopped, the player may be given the option to rotate the two side reels 704 and 712 around a center array 722 that forms a 3×3 array of symbols 714 as shown in FIG. 7A. The rotation may achieve more winning outcomes via the different paylines 730*a*-730*c* which now run through the fixed center array 722 and the now top and bottom symbol reels 704 and 712. The center array 722 may be used for subsequent plays of the wagering game in the new orientation.

In another implementation, the reel array 702 shown in FIG. 7A as a 3×5 array is rotated 90 degrees after the reels in the reel array 702 stop spinning. After the rotation, the reel array 702 becomes a 5×3 array as shown in FIG. 7B. The center array 722 remains static during the rotation, though in other embodiments, the center array 722 can rotate with the other symbols or can rotate in a direction opposite to the rotation of the other symbols in the reel array 702. The center array 722 may be used for subsequent rounds including bonus rounds or may be populated with new symbols in a subsequent round.

FIGS. 8A-8D are additional examples of wagering game display graphics 800, 850, which may be shown on the primary display 14 or the secondary display 16 of the gaming machine 10 or 110. A randomly-selected outcome is determined in response to receiving the wager input. The randomly-selected outcome is selected from a plurality of outcomes including at least one winning outcome. The display graphic 800 includes a three dimensional object that resembles a stack structure 802. The stack structure 802 has a number of visible faces having different layers 804, 806, 808, 810, and 812, each of which has symbols 814 on each exposed face of the stack structure 802. Each layer includes three longitudinal blocks that are arranged in a crisscross pattern relative to the adjacent blocks. Fruit-themed symbols are disposed on the ends of each block and along each exposed side of the block (though of course any symbol theme is contemplated by the present invention, including card symbols, numbers, colors, characters, and so forth). The plurality of outcomes may be represented by symbols on the different faces of the stack structure 802 visible to the player. In this example, two faces 816 and 818 are visible to the player. The combinations of symbols on the faces 816 and 818 composed of the layers 804-812 represent potential paylines that may be activated by a player. Of course it is understood that the entire stack structure 800 may be rotated to show the player other faces such as the opposite faces from faces 816 and 818 for additional symbols and potential winning paylines. Alternately or additionally, a predetermined combination of symbols on a layer (e.g., a banana symbol on each end block in one layer as well as banana symbols on each exposed side of that layer), may represent a randomly selected winning outcome. This aspect is explained in more detail in connection with FIGS. 8C and 8D below.

After an initial wager, the fruit-themed symbols are shown on the faces of the blocks in the layers 804-812 of the stack structure 802 and winning active paylines with multiple identical symbols such as the payline 820*a* yield an award. In this example, the layers 804-812 include a winning payline 820*a* containing identical symbols displayed as bananas along the payline 820*a*. As part of a subsequent round or a bonus game, the player may elect to replace a layer or part of a layer to change the symbols contained by any of the active paylines. Alternately, the wagering game may automatically replace a layer or a column or any portion of the stack structure 802 in subsequent rounds or as part of a bonus game. Note that in the illustrated example, the payline 820*a* spans along a column of the stack structure 802. Of course, paylines can span horizontally across the stack structure 802, but the illustration shows how it is possible for paylines to run vertically across the stack structure 802 as well. Additionally, paylines can run diagonally, or any combination of horizontal, diagonal, and vertical. Paylines can bend across multiple planes, such as bending from the face 816 to face 818.

Figure 8B:
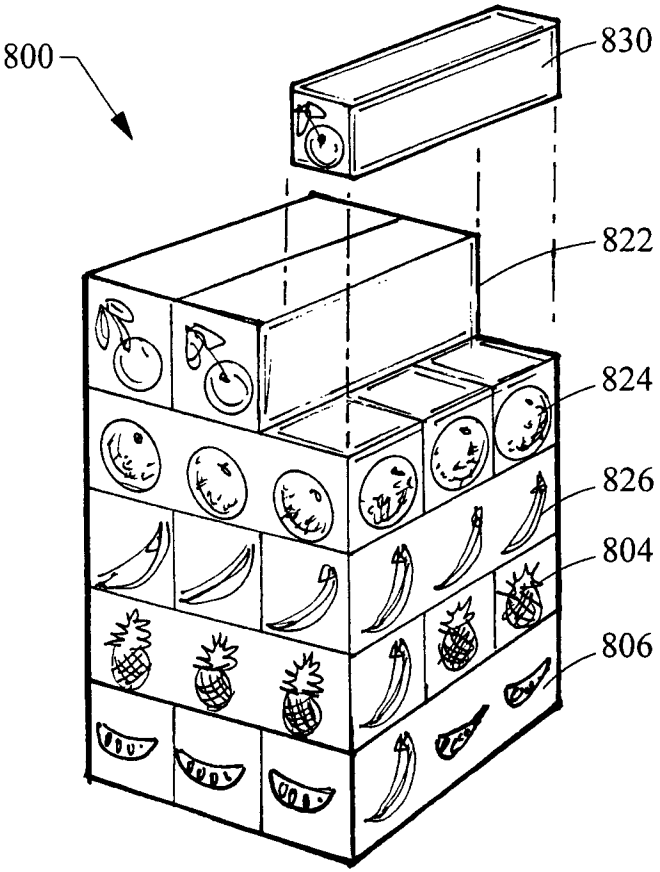
FIG. 8A-8D are illustrations of graphic displays for exemplary 3D wagering game with cascading blocks.

FIG. 8B shows the result of replacing new layers on the stack structure 802. In FIG. 8B, the original layers 804 and 806 have been dropped from the top two layers in FIG. 8A and are now the bottom two layers in FIG. 8B. Three new layers 822, 824 and 826 have been dropped onto the original layers 804 and 806. The old layers 808-812 in FIG. 8A have been dropped out of the graphic. The new layers 822-826 have new symbols which may form additional winning combinations and can be used in subsequent rounds or in a bonus game. As explained above, the payline 820*a* can span any surface of the stack structure 802 and can even bend around multiple faces, such as faces 816 and 818. The blocks in the stack structure 802 can be removed and replaced according to a cascade effect whereby blocks that are removed cause nearby blocks to fill the space where the previous blocks once occupied (typically the blocks fall in a downward motion as if by gravity, though in other embodiments, blocks can move upwards, sideways, or diagonally to fill empty spaces left by previous blocks). The space causes the entire stack structure 802 to include gaps (usually at the top of the structure 802), and these gaps are filled by new blocks, such as block 830 shown in FIG. 8B, which can be filled on a block-by-block basis or on a layer-by-layer basis. The new blocks create new symbol combinations that build upon the previous symbol combinations.

Instead of replacing an entire layer, replacing a part of a particular layer (such as a single block or group of blocks) may be offered. For example, in FIG. 8B, a block of the layer 822 has been removed and is being replaced by dropping a new block 830 to replace the space vacated by the previous block. The replacement of individual blocks or even individual cubes (each block comprising three cubes in the illustrated example) provides the opportunity for additional winning paylines by changing the symbols contained by the active paylines. While the blocks shown in FIG. 8A are arranged in a crisscross pattern relative to one another, in other implementations, the blocks can be arranged in other patterns.

Figure 8A:
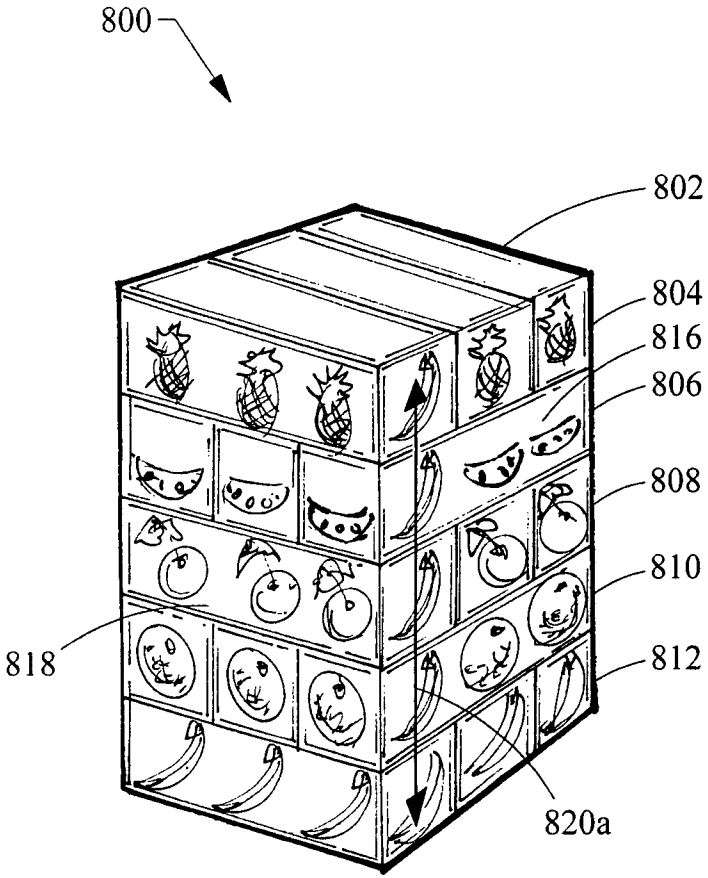
Figure 8D:
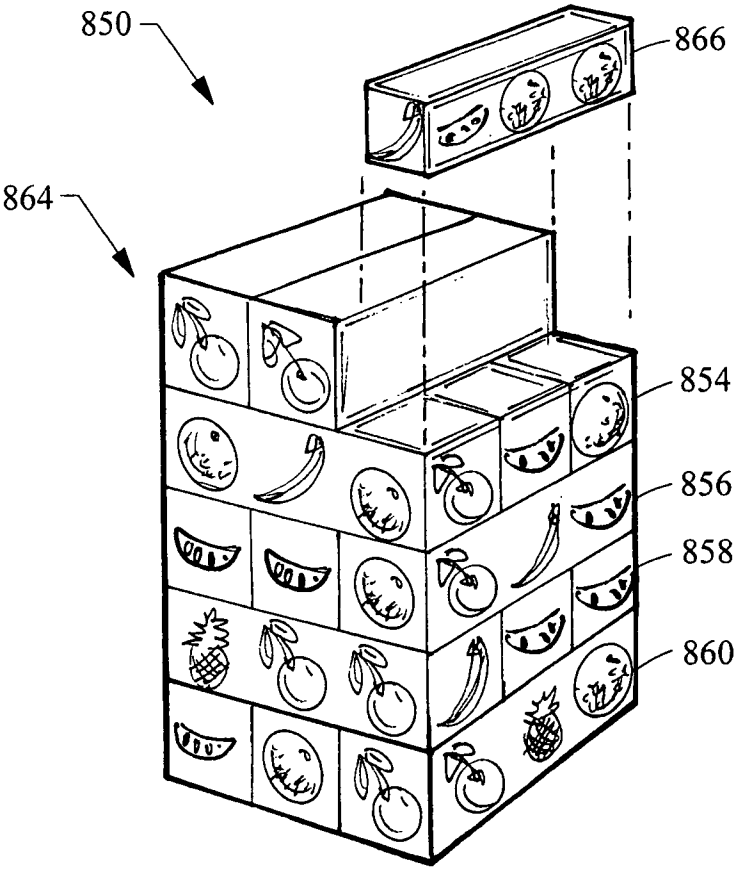
Figure 8C:
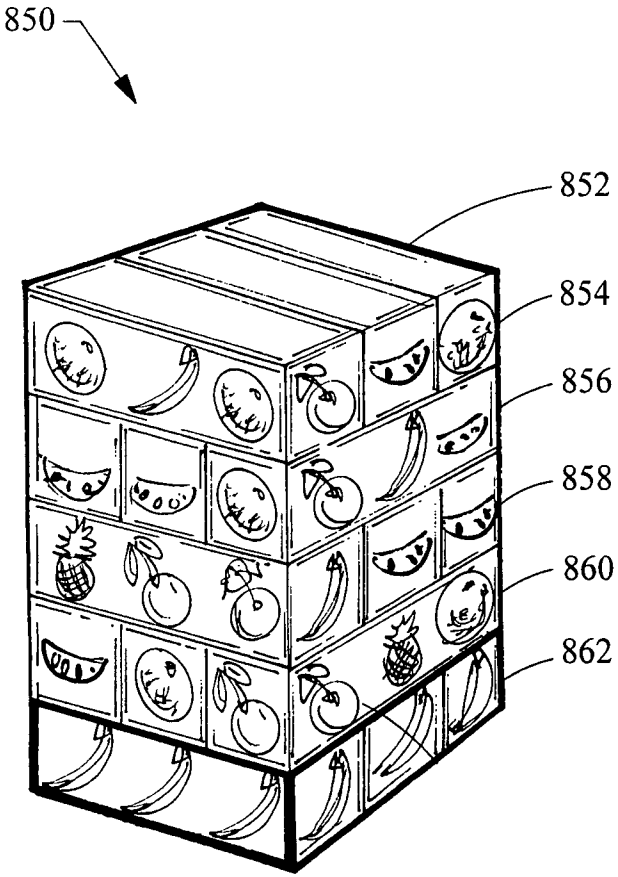

In FIGS. 8C and 8D, a wagering display graphic 850 is shown that includes a stack structure 852 like the stack structure 802 shown in FIGS. 8A-8B. The stack structure 850 includes five layers 854, 856, 858, 860, 862 comprising three blocks per layer. The blocks are arranged in a crisscross pattern relative to one another as shown. The bottommost layer 862 bears identical symbols across the exposed surfaces of the blocks comprising that layer 862. In an implementation, this combination represents a winning outcome, and in a subsequent round or a bonus game, the wagering game uses a cascading effect to rearrange the blocks as follows. The bottom layer 862 disappears, and an animation to that effect may be displayed, such as the bottom layer 862 may appear to slowly fade or disintegrate until it is no longer visible. Then, the layers above the now missing bottom layer 862 appear to move downward until the layer 860 replaces the previous layer 862. The subsequent layers 858, 856, 854 move down accordingly such that at the top of the stack structure 852 there is a space for a new layer 864 to be placed. The new layer 864 can be animated to move as a layer onto the top of the layer 854 or can be animated to move block-by-block onto the top of the layer 854. For example, the last block to be placed on top of the layer 854 is block 866. As these new blocks cascade onto the top of the stack structure 850, replacing previously removed blocks, new possible winning outcomes are presented based on the previous blocks. By building upon the stack structure 850 in accordance with the implementations described in connection with FIGS. 8A-8D, the player desires to continue playing the wagering game because there is continuity from one round to another. The 3D aspect added by the present invention creates multiple new possible winning combinations and paylines that can bend around multiple faces, enhancing player retention and interest in the wagering game. Furthermore, multiple surfaces of a wagering-game element are now usable. The viewing angle of the stack structure 802 or 852 can be controlled by the player, giving the player a sense of control and manipulation over the wagering-game elements being displayed and creating the impression of control over the game outcome. Such control of course would be merely perceived and would not necessarily reflect reality.

Figure 9:
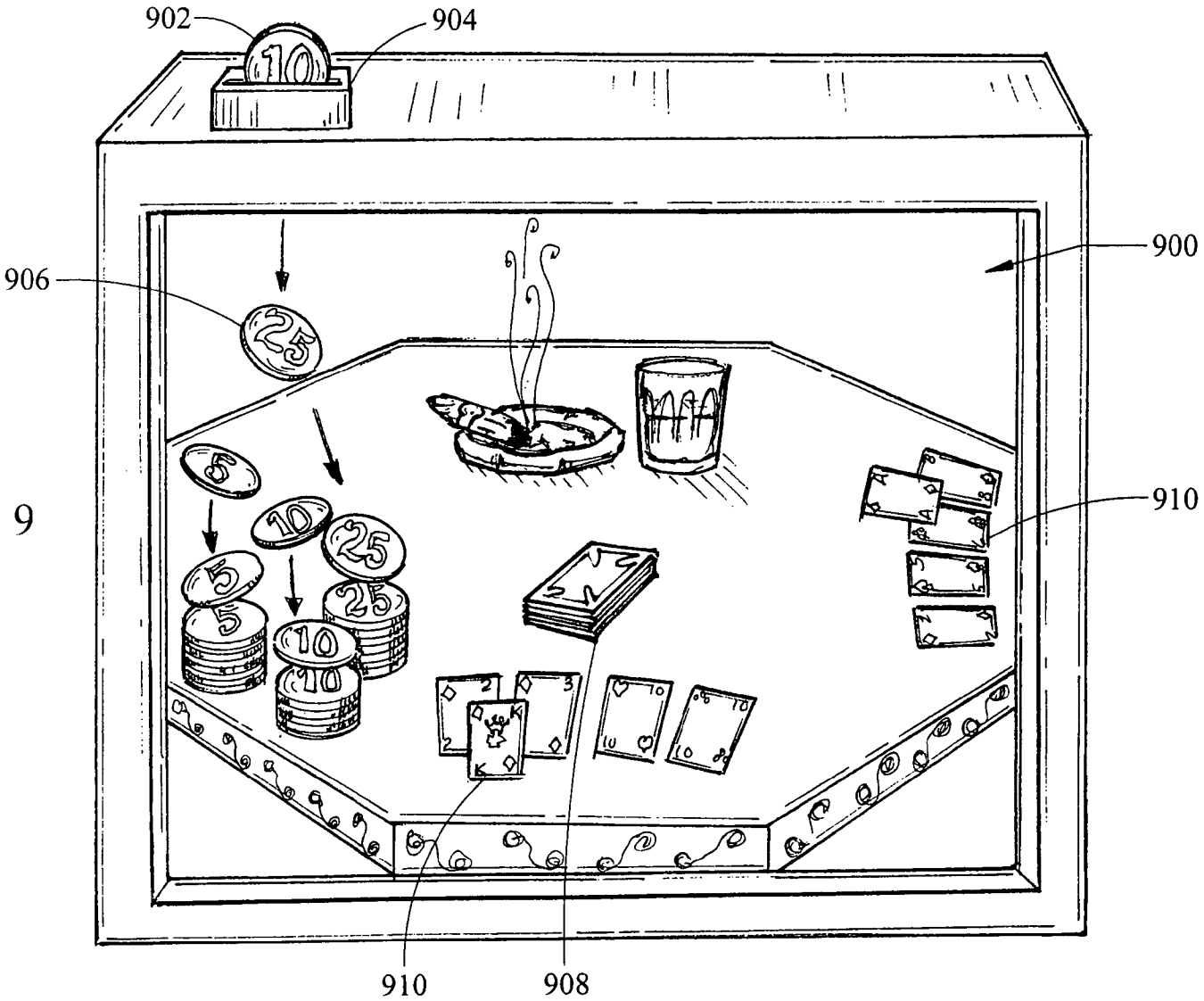
FIG. 9 is an illustration of a graphic display for another example coin or token operated three dimensional wagering game.

FIG. 9 is another example of a wagering-game display 900, which may be utilized on the primary display 14 or the secondary display 16 of the gaming machine 10 or 110. A player may insert a physical token or coin 902 or other object via a physical coin slot 904 on a coin/token accepter that may be placed near the display 14 on the gaming machine 10. When the physical coin 902 is inserted in the coin slot 904, the wagering game renders a three dimensional graphic of a coin 906 or other appropriate token on the display 900. In this manner, a player may view a visual three dimensional representation of their wager as it transitions from the physical world into the virtual world displayed on the display 900. The physical coin 902 continues to be received within the gaming machine 10 or 110 and is not actually viewed by the player once received by the coin/token acceptor, but the animation on the display 900 simulates the travel path of the coin as if it were to continue traveling down a chute. The coin graphic 906 may be animated to be displayed as dropping into the display 900. For example, the graphic 900 shows a table with stacks of different denominations of coins that may represent player wagers or payouts. The display 900 may also display different levels that appear to catch the coin 906 to represent different wagers by the player. The graphic display 900 may be used in conjunction with a randomly selected outcome, which is determined in response to receiving the wager input. The randomly-selected outcome is selected from a plurality of outcomes including at least one winning outcome. In the illustration, the graphic display 900 is a part of a simulated card-wagering game where a three dimensional deck of cards 908 may be shown to be shuffled in front of the player to provide a player hand 910. The player may make the coin wager and simulate the dealing of cards for the player hand 910.

FIG. 9 can be adapted to display a wagering game with paylines at different levels that represent coin sizes. For example, the first level can stop all dimes, the second level stops all nickels, the third level stops all quarters, and so forth. As a player drops in coins or tokens into the coin/token acceptor of the gaming machine 10, 110, they are transitioned into a virtual representation of the coin and stop at the level according to their denomination. To create a horizontal payline at the first level, for example, the player would deposit three dimes (representing three columns of wagering-game elements), and the wagering game would draw a horizontal payline at the first level.

Figure 10B:
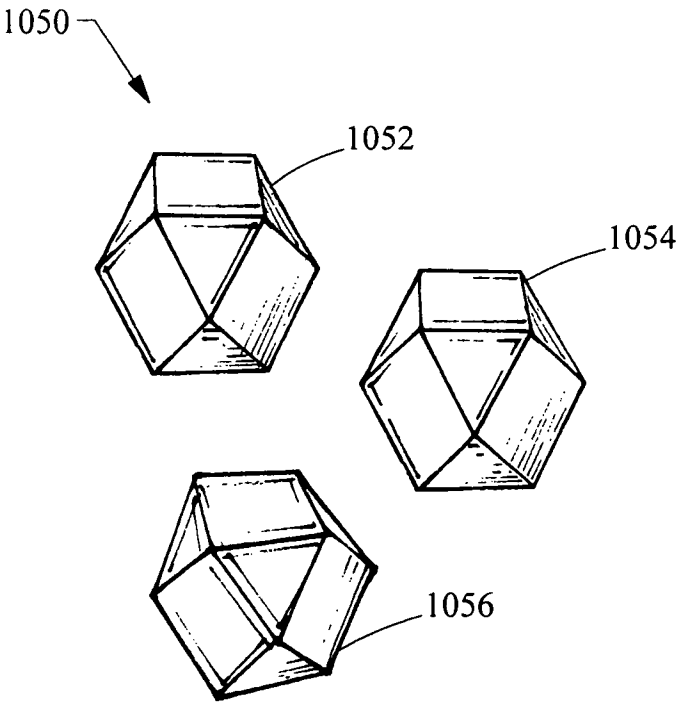
FIG. 10A-10B are illustrations of graphic displays for example dice type three dimensional wagering games.
Figure 10A:
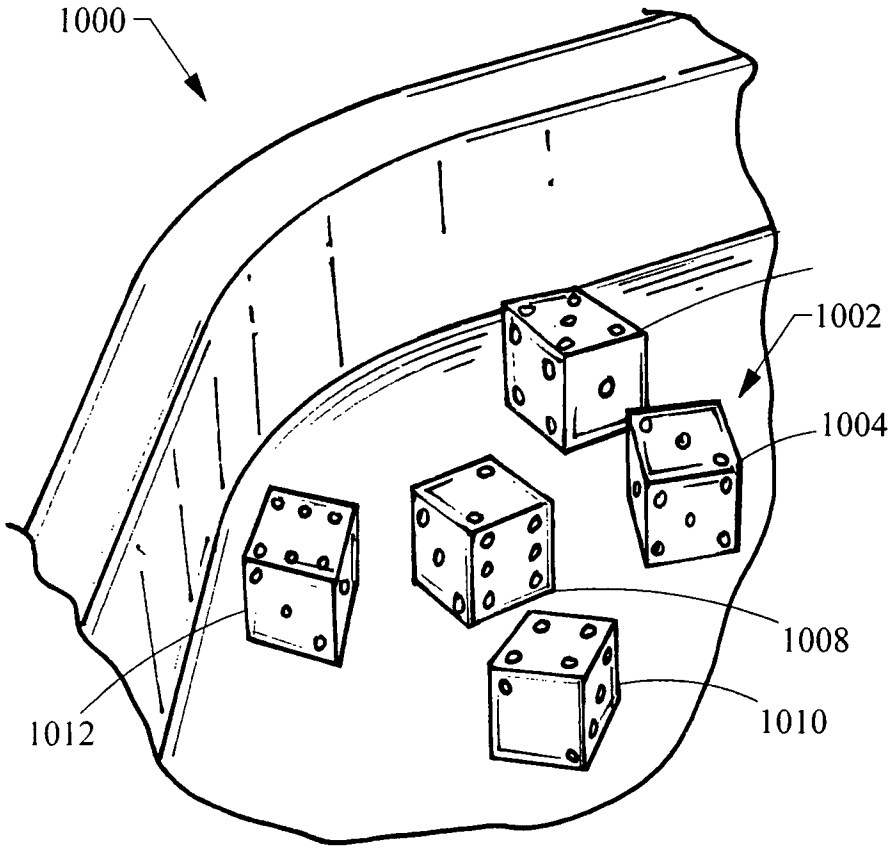

FIG. 10A is another example of a wagering-game display graphic 1000 associated with a dice-related game, which may be shown on the primary display 14 or the secondary display 16 of the gaming machine 10 or 110. A randomly selected outcome is determined in response to receiving the wager input. The randomly selected outcome is selected from a plurality of outcomes including at least one winning outcome. The plurality of outcomes may be shown on the different faces of a stack of dice 1002. The stack of dice 1002 may be rendered to be "thrown" by a player to scatter resulting in different dice 1004, 1006, 1008, 1010 and 1012 landing in the display 1000. Each of the dice such as the die 1004 has different faces with conventional symbols of pips on each face. Of course other types of symbols may be used for the die faces. A player may make wagers and roll the dice to obtain payoffs based on outcomes shown on the face of the dice 1004-1012. Numerous dice games may utilize the graphic 1000 such as YAHTZEE®, Sic Bo, craps, etc. to simulate the roll of the dice. A variation of the dice throw may be to render a graphic of a single die that breaks up into multiple dice cubes when it is thrown. The number of dice cubes may be predetermined or variable and unknown to the player at the time the player throws the single die. A player may select how many pieces the dice may be broken up into and place a wager based on the faces of the component cubes.

FIG. 10B is another example of a wagering game graphic 1050 associated with a dice-related game, which may be shown on the primary display 14 or the secondary display 16 of the gaming machine 10 or 110. A randomly selected outcome is determined in response to receiving the wager input. The randomly selected outcome is selected from a plurality of outcomes including at least one winning outcome. In this example, the player is allowed to roll 3D-rendered polyhedron multi-sided dice 1052, 1054, and 1056. The sides of the dice such as the die 1052 have different symbols that represent different combinations. In this example, the dice 1052-1056 have twenty sides representing different combinations of up to twenty symbols on each of the faces of the dice. A player may select different combinations of symbols on the different faces of the dice in order to make wagers to be awarded winning outcomes.

Figure 11:
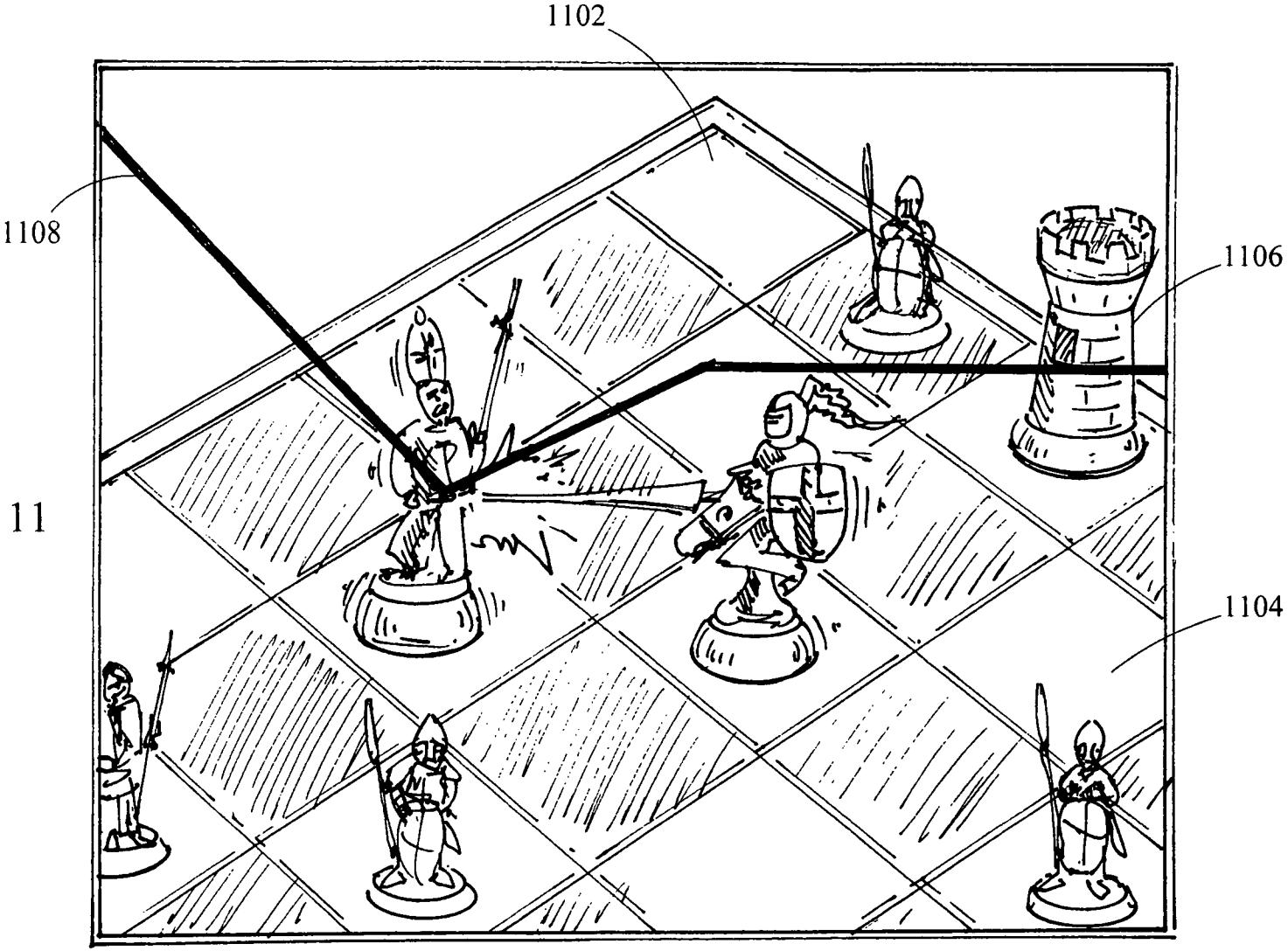
FIG. 11 is an illustration of a graphic display for an example board game adapted for a three dimensional wagering game.

FIG. 11 is an illustration of a three-dimensional display graphic 1100 that may be displayed on either the primary display 14 or the secondary display 16 on the gaming machine 10 or 110. The display graphic 1100 includes a gameboard 1102, which in the illustrated example resembles a chessboard. The chessboard 1102 includes a number of spaces 1104 that can be occupied by various pieces 1106, such as pieces associated with the game of Chess. Each piece 1106 represents a wagering-game element of the wagering game. In this example, the pieces 1106 are three-dimensional representations of chess pieces such as a ROOK, a BISHOP, a KNIGHT, and various PAWNS. A randomly selected outcome is determined in response to receiving a wager input from the player. The randomly selected outcome is selected from a plurality of outcomes including at least one winning outcome. The winning outcome may be represented by the position of the pieces 1106 in relation to a payline 1108. The payline 1108 can span across multiple dimensions of the chessboard 1102 such as through the ROOK and the BISHOP chess pieces as shown. The player may be awarded an extra option to move a piece according to chess rules to make a losing payline 1108 to a winning payline. A player may also earn awards or bonuses by capturing or eliminating other pieces via their moves. Of course other variations involving the movement of game pieces for other board games in three dimensions may be used.

Additionally, wagering-game elements may interact with one another in 3D space. For example, in FIG. 11, the KNIGHT chess piece is shown interacting with the BISHOP chess piece, and the interaction reveals which wagering-game elements are involved and the completion of the interaction results in a modification of the wagering-game element position or graphic. For example, the KNIGHT chess piece begins the interaction with the BISHOP, and the interaction may be animated to show a short battle scene whereby the KNIGHT attacks the BISHOP and they begin to do battle. At the completion of the battle, the KNIGHT has moved into the position previously occupied by the BISHOP and the BISHOP piece is removed from the chessboard 1102. Thus, as a result of the 3D interaction, the position of the KNIGHT has changed (it moved from the position shown in FIG. 11 to the position occupied by the BISHOP), and the BISHOP wagering-game element has been removed from the display. In that respect, the BISHOP wagering-game element was modified in that it was actually removed from the chessboard 1102. Another modification may be the promotion of a PAWN to a QUEEN when a pawn reaches the opposite end of the chessboard 1102 in accordance with the rules of Chess. These modifications can be predictable (such as following rules of Chess) or unpredictable/unknown to the player. The modifications resulting in interactions among wagering-game elements can occur prior to or subsequent to the display of an active payline, such as payline 1108.

Other three dimensional graphics displaying multiple dimension winning outcomes or other highlights of three dimensional graphical objects may be rendered. These may include a player's choosing the lighting of different 3D-rendered objects in a 3D-rendered display. For example, the color of the symbols or objects may be altered by a lighting effect. The player may select a low, medium, or high lighting as a wager (each demanding a progressively higher wager amount). During the wagering game, the lighting will be directed at colored wagering-game symbols in accordance with the intensity reflected by the player's wager amount. The light source(s) may be movable by the player either as a function of a wager amount or independent of a wager amount. The player's ability to move the light source creates the perception in the player in a sense of control over the game outcome. The lighting effects are rendered in real-time according to algorithms that simulate how colored objects reflect light according to different intensities and based upon the angle of the light source.

Another variation involves a player's placing a wager by buying different colors to highlight an object in a wagering game. Different colors may represent different payments for winning outcomes. For example, triple payment of an award may be given for lighting an object with three different colors. In an implementation, the light sources can be regularly roving around in a predetermined or random or pseudo-random pattern, and when a light source illuminates an object displayed in the 3D environment, an award can be made. Player wagers can be based upon the number of light sources or the type of object to be illuminated by a light source to achieve a payout. The roving light sources resemble moving or movable paylines.

In another implementation, a wagering game includes 3D symbols that appear to float in 3D space. A winning outcome can be defined by a 3D payline that extends across a combination of 3D symbols floating in 3D space.

In another implementation, a wagering game resembles a 3D bowling game, where the winning outcome is represented by how many pins and what pattern of pins remain after a virtual bowling ball is thrown down the virtual lane. A gutter ball may represent a winning outcome or no winning outcome. The direction and speed of the ball may be controlled by the player, giving the player the mere perception of control over the game outcome, even though the game outcome may already be predetermined.

In another implementation, a player selects one or more shapes as part of a wager on a wagering game. After the wager has been placed and the player has selected the desired shape(s), the wagering game displays a "shower" of 3D-rendered shapes that fall down the display. As the shape(s) selected by the player pass by, the player keeps that shape and it is stored or accumulated in a shape counter. The player's award is determined by the number of shapes in the shape counter (which can be graphically displayed as a bucket, for example). The player may regret choosing a shape that has a lower pay award at the completion of a wagering game. For example, squares may have a lower pay award but a higher frequency while stars may have a higher pay award but a lower frequency. The player may select squares as part of a wager, but may only accumulate a few squares during the wagering game in addition to one or more squares, which, had the player selected squares, would have yielded a larger award. The player can adjust the wager to accommodate a higher risk but greater award in subsequent rounds. The 3D shower shows to the player all the shapes that could have been accumulated during a wagering game. This type of wagering game can exploit psychological or "eye trick" effects on a player, whereby the player visually perceives one shape appearing more often than others (even though it actually may not be), motivating the player to wager on that shape in a subsequent round even though it may actually present a lower probability of an award.

Preferably, the gaming machine 10 according to the present invention generates the 3D effects in real-time with a 3D engine. The result is a much more interactive and interesting environment for the gaming player. In one embodiment, the 3D virtual controls may be implemented using a game design package such as RenderWare Studio 2.0 running, for example, on a processor designed by Intel or AMD. The views of the 3D graphics described above on the display 14 are 3D views of the gaming environment designed or configured to a desired theme or game. The theme is filmed in a 3D gaming environment using at least one virtual camera that renders a sequence of two-dimensional (2D) images or photographs derived from 3D objects (e.g., the themed reels) in the 3D gaming environment. A 3D position of each 3D object in the 3D gaming environment in the sequence of 2D images is defined by a position of the virtual camera in the 3D gaming environment. A sequence of positions of the virtual camera in the 3D gaming environment used to film the theme may be pre-selected, or the sequence of positions of the virtual camera may be controlled by a player at the gaming machine 10. Alternatively, a physics engine may be implemented that realistically animates physical objects within the gaming environment.

The 3D views of the gaming environment of the present invention are displayed in real-time on the display 14 in FIG. 1*a*. In a real-time determination and display embodiment, game activity is shown on the display 14 at substantially the same time that the underlying mathematical basis for the displayed game activity is being calculated. Furthermore, according to the present invention, the activities and movement of each of the objects shown in the display 14 occur simultaneously. For example, a first sequence of photographs for the first reel generated from a virtual camera in the gaming environment is displayed simultaneously with a second sequence of photographs for the second reel generated from the virtual camera. More than one virtual camera may also be used. This technique is sometimes referred to as "rendering on the fly."

In conjunction with any or all of the above examples, graphics may be rendered using a physics engine as part of the CPU 34 and/or the 3D engine. For example, the controller 34 may access rules relating to a world from the system memory 36 and forward those rules to the 3D engine for graphical rendering of the effects of the rules on graphical objects within a simulated world. Alternatively, the 3D engine may be designed to run simulations within a simulated world with physical properties closely mimicking the real world, so that the same general rules, such as the effects of gravity or the results of collisions, can be carried out from game to game without any need to update the 3D engine with new rules for different game types. At this point, the 3D simulation world may be merely numerical in nature, with the 3D engine using the numerical world information to form a geometric world which can be shown to the player via the display.

The mathematical basis of a gaming activity portrayed via the above examples may be based on real-world physics describing the interactions between physical objects. The mathematical basis for physical interactions between objects portrayed by a gaming machine may be based on a readily available "physics engine" or program which is designed to realistically simulate a wide variety of physical phenomena, or separate underlying mathematical rules may be provided on a specialized basis for specific game actions to be simulated. A variety of types of data may be used to simulate game activities. Several general data types are particularly beneficial such as physical object data, motion capture data, and simulation rule data. These types of data are used together, though it is to be understood that these types of data may be used in other combinations or alone. Physical object data may comprise a variety of types of information about physical objects whose motions and interactions are to be simulated. The mass, dimensions, elasticity, and center of gravity of a simulated object may be taken together or separately to comprise the physical object data.

Physical object data may be used in combination with manual animation of simulated objects, or it may be combined with motion capture data. Further, a combination of motion capture data and manual animation may be used to create more realistic or more stylized depictions of game activities. Motion capture data includes data that is acquired from observation of physical objects, actors, or animals. Several techniques are available for capturing digital information on motion, including optical and electronic motion capture as is known in the field of computer animation.

Simulation rule data comprises a set of parameters describing how simulated objects should work together within a simulated environment to provide an entertaining activity for wagering. According to one example, the simulation rule data comprises rule data designed to mimic as closely as possible activities within the real world.

Each of these embodiments and obvious variations thereof is contemplated as falling within the spirit and scope of the claimed invention, which is set forth in the following claims.

What is claimed is:

1. A gaming system for a wagering game, comprising:

a first three dimensional reel including a reel strip in a loop shape having an outside surface with a first plurality of symbols and an opposite inside surface with a second plurality of symbols, the first and second plurality of symbols simultaneously viewable from a single direction of the first three dimensional reel, wherein the first three dimensional reel is offset to display symbols from both the outside section and the inside section of the reel strip;

an active payline containing at least one symbol from the inside surface of the reel strip of the first three dimensional reel; and a controller to represent a randomly selected outcome of the wagering game via the at least one symbol contained in the active payline.

2. The gaming system of claim 1 further comprising:

a second three dimensional reel in a loop shape having a plurality of symbols on an outside surface and an inside surface of a second reel strip; and wherein the active payline contains a symbol of the first three dimensional reel and a symbol of the second three dimensional reel.

3. The gaming system of claim 1, wherein the active payline contains at least one symbol of the outside surface of the reel strip of the first three dimensional reel.

4. The gaming system of claim 1, wherein a symbol viewable from the inside surface of the reel strip of the first three dimensional reel is reversed.

5. The gaming system of claim 2, wherein the active payline contains a symbol of the outside surface of the reel strip of the first three dimensional reel.

6. A gaming system, comprising:

a first three dimensional reel in a loop shape having a plurality of symbols viewable from a front side and a back side of a reel strip of the first three dimensional reel, wherein the first three dimensional reel is offset to display symbols from both the front side and the back side of the reel strip, wherein the three dimensional reel is in the shape of mobius strip, the mobius strip having opposite surfaces with different symbols;

an active payline containing at least one symbol from the back side of the reel strip of the first three dimensional reel; and a controller to represent a randomly selected outcome of the wagering game via the at least one symbol contained in the active payline.

7. A method of conducting a wagering game having a randomly-selected outcome, the method comprising:

using a user interface device to accept the player input, and transforming the player input to electronic data signals indicative of a wager to play the wagering game;

using one or more processors to interpret the wager from the data signals and to cause the recording of a digital representation of the wager in one or more storage devices;

using at least one of the processors to initiate the game sequence of the wagering game on the gaming apparatus;

displaying on a display of a gaming machine a first three dimensional reel in the shape of a mobius strip having a plurality of symbols viewable from a front side and a back side of a reel strip of the first three dimensional reel; and using at least one of the processors to provide an active payline containing at least one symbol from the back side of the first three dimensional reel; and using at least one of the processors to represent the randomly selected outcome game via the at least one symbol contained in the active payline.

8. The method of claim 7 further comprising:

displaying on the display a second three dimensional reel in the shape of a mobius strip having a plurality of symbols viewable from a front side and a back side of a reel strip of the second three dimensional reel; and wherein the active payline contains a symbol of the first three dimensional and a symbol in a different dimension of the second three dimensional reel.

9. The method of claim 7, wherein the front side and back side of the reel strip of the first three dimensional reel have different symbols.

10. The method of claim 7, wherein the active payline contains at least one symbol of the front side of the reel strip of the first three dimensional reel.

11. The method of claim 7, wherein a symbol viewable from the back side of the reel strip of the first three dimensional reel is reversed.

12. The method of claim 8, wherein the active payline contains a symbol of the front side of the first three dimensional reel.

13. A gaming system for playing a wagering game, the system comprising:

a plurality of three dimensional loop shaped reels, each of the plurality of reels including a reel strip having an outside surface with a first plurality of viewable symbols and an opposite inside surface with a second plurality of viewable symbols; and an active payline containing one viewable symbol on each of the plurality of three-dimensional loop shaped reels, including at least one viewable symbol from the opposite inside surface of one of the plurality of three-dimensional loop shaped reels.

14. The gaming system of claim 13, wherein one of the plurality of three dimensional reels is a mobius shape having two opposite sides.

15. The gaming system of claim 14, wherein the two opposite sides have different symbols and the active payline contains a symbol on one of the two opposite sides.

* * * * *

UNITED STATES PATENT AND TRADEMARK OFFICE

CERTIFICATE OF CORRECTION

PATENT NO. : 8,628,399 B2
APPLICATION NO. : 12/526098
DATED : January 14, 2014
INVENTOR(S) : Aoki et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1121 days.

Signed and Sealed this
Twenty-second Day of September, 2015

Michelle K. Lee

Michelle K. Lee
*Director of the United States Patent and Trademark Office*